US007062855B2

(12) United States Patent
Merheje

(10) Patent No.: US 7,062,855 B2
(45) Date of Patent: Jun. 20, 2006

(54) NAIL CUTTER WITH DOUBLE LEVER

(76) Inventor: Michel Yamin Merheje, Alameda Caiapos 262, Barueri, Sao Paulo (BR) 06470-280

( * ) Notice: Subject to any disclaimer, the term of this patent is extended or adjusted under 35 U.S.C. 154(b) by 0 days.

(21) Appl. No.: 11/046,148

(22) Filed: Jan. 28, 2005

(65) Prior Publication Data

US 2006/0026839 A1 Feb. 9, 2006

(30) Foreign Application Priority Data

Aug. 4, 2004 (BR) ..... 0403280

(51) Int. Cl.
*A45D 29/02* (2006.01)

(52) U.S. Cl. ..... 30/28; 132/75.5

(58) Field of Classification Search ..... 30/26–29, 30/90.1, 175, 194; D28/60; 132/75.5; 294/99.1–99.2; D8/52

See application file for complete search history.

(56) References Cited

U.S. PATENT DOCUMENTS

| | | | | |
|---|---|---|---|---|
| 113,212 | A * | 3/1871 | Carew-Gibson | 279/97 |
| 796,389 | A * | 8/1905 | Wright | 132/75.5 |
| 2,515,852 | A * | 7/1950 | Bilsky | 30/28 |
| 5,063,666 | A * | 11/1991 | Tsay | 30/28 |
| 6,173,497 | B1 * | 1/2001 | Domenge | 30/28 |
| D459,549 | S * | 6/2002 | Savoie | D28/60 |
| 6,941,657 | B1 * | 9/2005 | Choi et al. | 30/28 |

* cited by examiner

*Primary Examiner*—Allan N. Shoap
*Assistant Examiner*—Laura M. Brean
(74) *Attorney, Agent, or Firm*—Michael C. Cesarano; Akerman Senterfitt

(57) ABSTRACT

A nail cutter has movable two corresponding and opposing levers and a "U" shaped cutting element that is made from a single block piece and having open fore ends that terminate in opposing cutting edges. The cutting element has a through hole in each of its arms, such holes receiving a pin having an oblong opening through the pin. Two shafts extend through small receiving holes at the ends of each corresponding and opposing lever, and each shaft further extends through the oblong opening in the pin, each shafts being at an opposite end of the oblong opening.

3 Claims, 4 Drawing Sheets

NAIL CUTTER WITH DOUBLE LEVER

BACKGROUND OF THE INVENTION

The present invention is a nail cutter having an actuation system based on two opposably movable levers.

The current state of the art covers a large number of nail cutters, a majority of which involve a base structure made up of two metallic blades welded at their posterior ends, and which, at their respective free ends, have a cutting edge adapted to produce nail cutting. The two metallic blades, after welding, receive a pin that passes through them at a point located close to the cutting edges. The pin presents a broadened lower head that prevents it from slipping through the hole in the lower blade of the cutter. The pin is long enough to extend through a corresponding hole in the upper blade. That hole is aligned with the corresponding hole through in the lower blade of the conventional cutter.

The upper end of the pin has a reentrance cavity located above the upper blade level, and provides support for the end of the actuating lever which, upon actuation, compresses the upper cutting blade against the lower cutting blade, thus creating movement between the cutting edges.

This type of construction is common in conventional nail cutters, and presents some inconveniences in manufacturing, among which is the fact that the two metallic blades must be welded together and joined before the cutter may be assembled. Such welding operation requires complete precision, especially with respect to the positioning of the metallic blades which, if not done properly, will misalign the cutting edges and reduce the effectiveness of the cutter. In view of this inconvenience, the nail cutter of this invention was developed with a simpler construction than that used by conventional clippers.

SUMMARY OF THE INVENTION

The nail cutter of this invention requires a total of six basic parts for its construction, two of them being of the same type. The assembly requirements for the nail cutter of this invention eliminate some of the manufacturing concerns with conventional clippers, as the cutting element is configured to the activations handles without the need for welding.

DETAILED DESCRIPTION OF THE PREFERRED EMBODIMENTS

Figure 1:
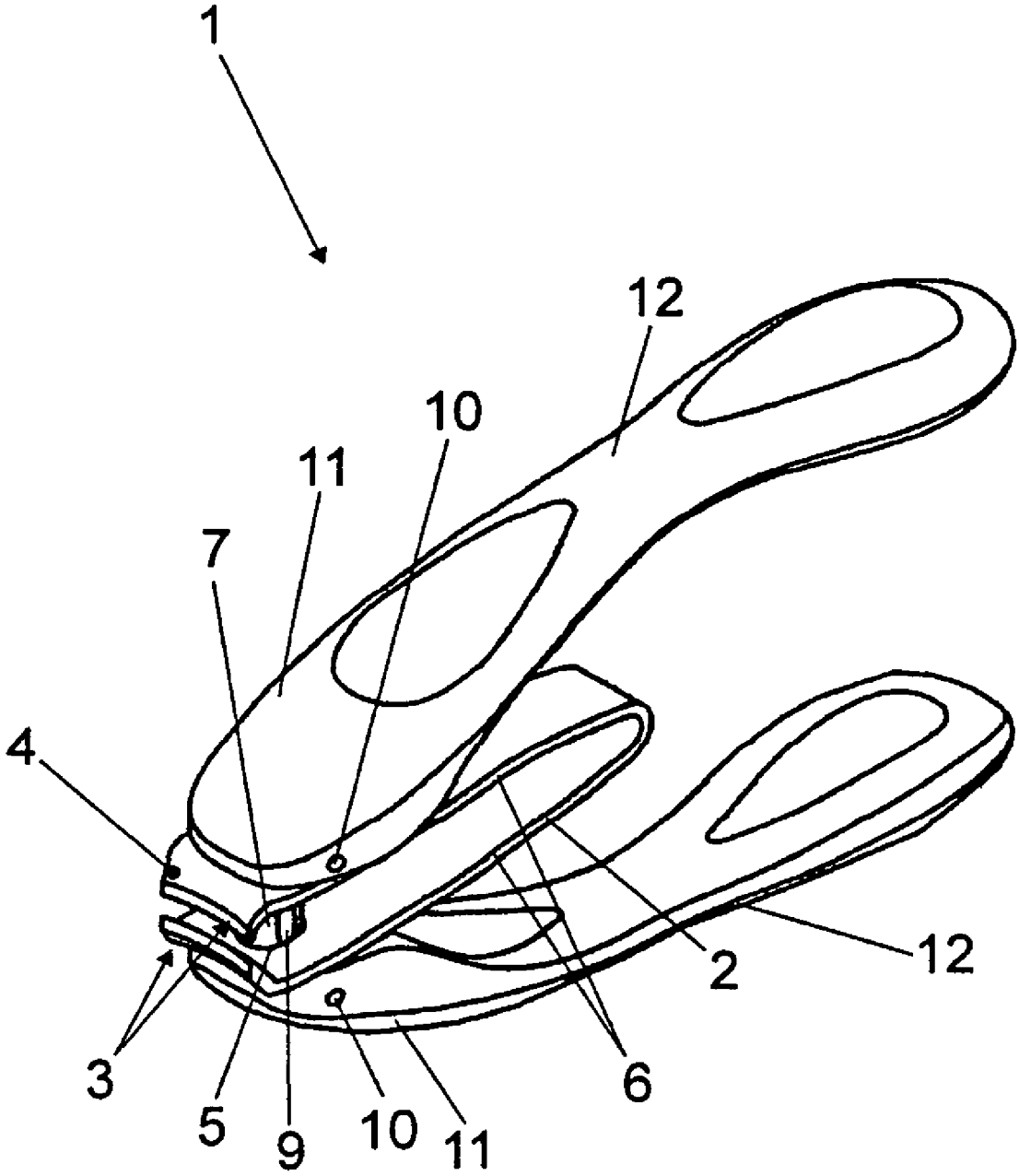
FIG. 1 is a perspective view of the nail cutter of this invention.

In FIG. 1, the nail cutter of this invention 1 is shown as having a full and single block piece formed into a spring cutting element 2 in a "U" shaped configuration, and having at its open ends 3 sharpened surfaces representing cutting edges 4. Cutting element 2 has a through hole 5 in each of its arms 6, such holes having a pin 7 passed through them. In operation, levers 12 are moved toward one another, causing the cutting edges 4 of spring 2 to approach one another and close with a clipping movement.

Figure 2:
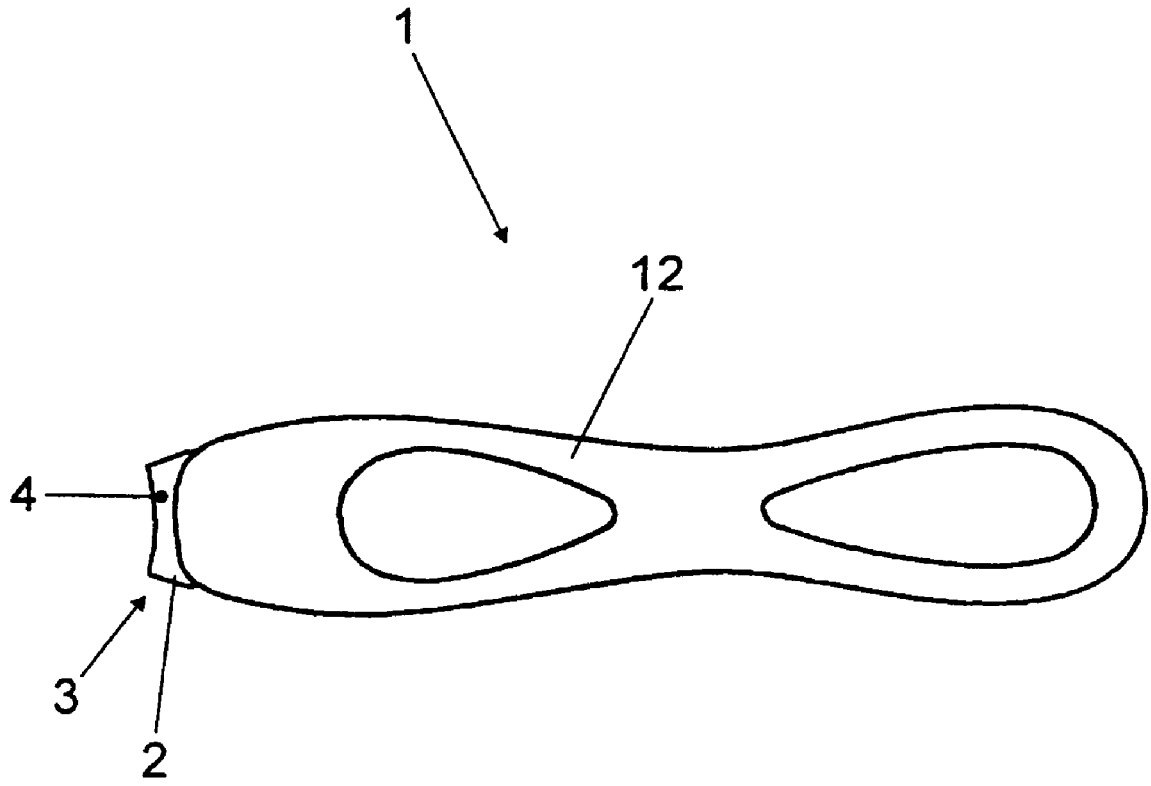
FIG. 2 is an upper view of the nail cutter of this invention.

FIG. 2 shows a plan view of the upper lever 12 and its position relative to spring cutting element 2, the ends of the element 3, and the cutting surfaces 4.

Figure 3:
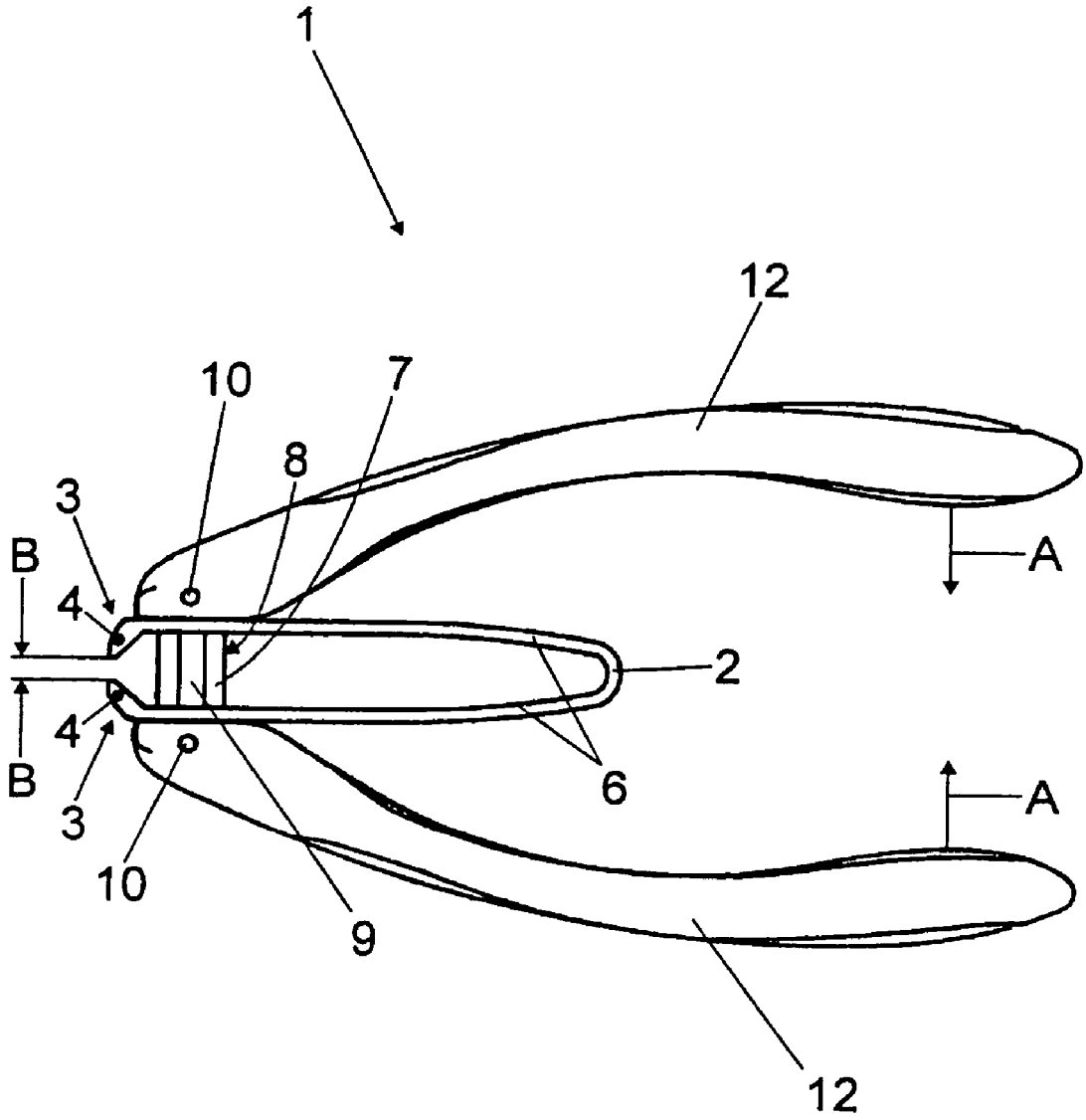
FIG. 3 is a side view of the nail cutter of this invention.

As is shown in FIG. 3, cutting element 2 is formed into a "U" shape and is made from steel that has a spring effect that is biased toward maintaining the free ends apart. Cutting element 2 is mounted between the two opposed levers 12, which are fastened together with the pin 7. The compression effect of levers 12, as indicated by arrows A of FIG. 1 provokes a compression of the arms 6 of the cutting element 2, thus advancing the cutting edges 4 in the direction indicated by arrows B.

Figure 4:
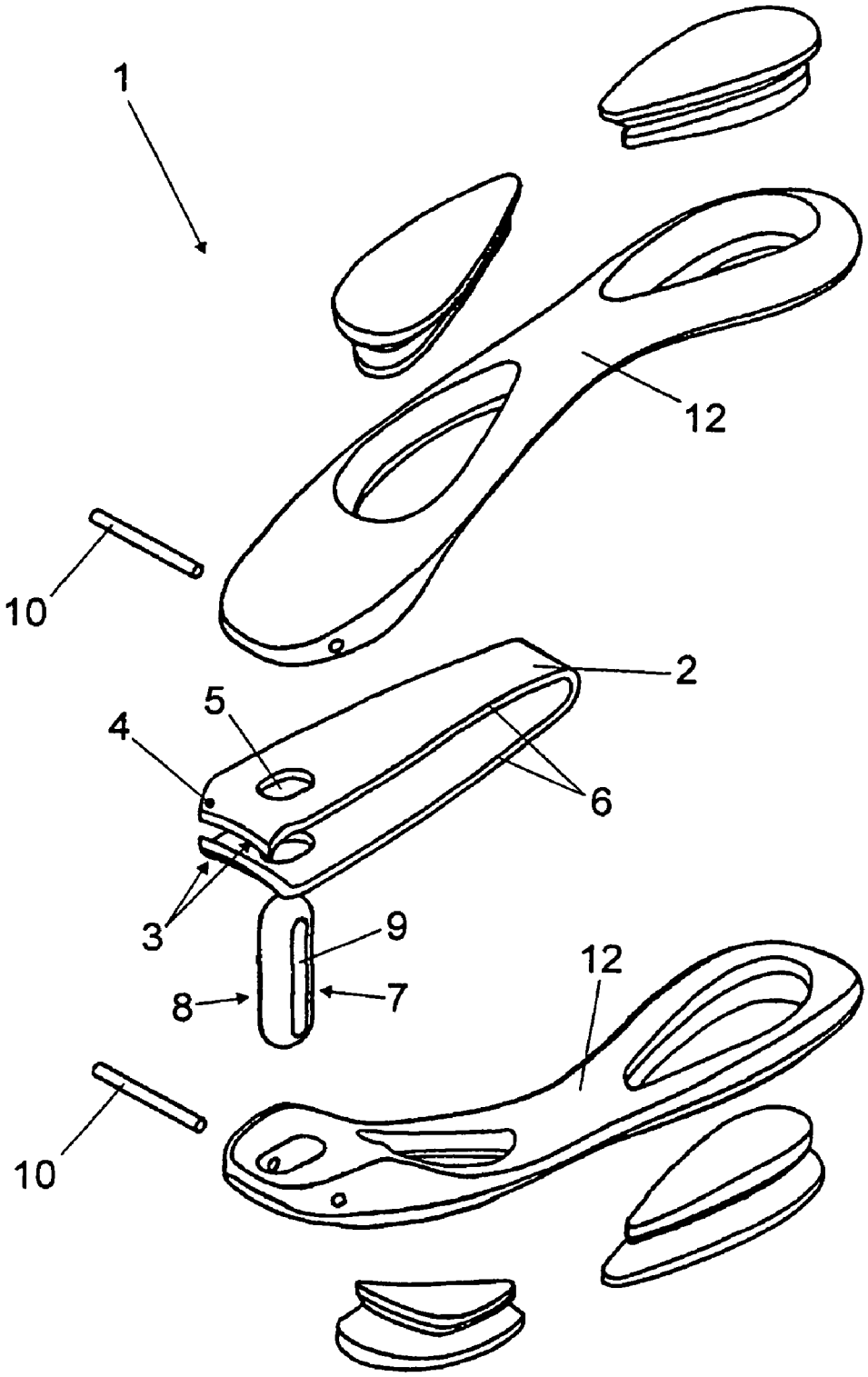
FIG. 4 is a perspective view of the components comprising the nail cutter of this invention.

In FIG. 4 it may be seen that the pin 7 has an oblong opening 8,9 extending toward either end. Shafts 10 are passed through small holes located in the fore ends 11 of levers 12, and also pass through opposite ends of the oblong opening 9 of pin 7. As so configured, the opposing motion of the levers is transmitted through the shaft in each lever and through the pin, which prevents the ends of the levers from being forced apart. As the levers continue to move toward one another, they press upon opposite sides of the spring cutting element, forcing the cutting blades to close in a clipping motion.

The general build of the nail cutter 1 can be understood from FIG. 3 where it is shown from its side angle.

As can be verified from the description and the drawings, the nail cutter 1 is basically made from four different component types, i.e. the cutting element 2 (a single piece), the pin 7 (a single piece), the levers 12 (two pieces) and the shafts 10 (two pieces), amounting to a total of six components. The nail cutter of this invention has component parts whose assembly does not require welding, an advantage that simplifies and cheapens its overall production cost. From the configuration of its levers 12, the cutter shows a type of slip-free or non-skid handle pads found in cutting pliers, and which provide greater handling safety.

It is noted that the nail cutter herein can take on other shapes and forms, and is not limited other than by the following claims.

What is claimed is:

1. A nail cutter comprising:

a pair of opposing and corresponding levers, a cutting element made from a single block piece, said cutting element being formed to have opposing fore ends and having cutting edges located at said fore ends, said cutting element further comprising a through hole in each of said fore ends, said holes receiving a pin, having an oblong opening therethrough extending along the longitudinal length of said pin, said oblong opening receiving a shaft through said opening at each end of said opening, each said shaft being positioned within opposing receiving holes extending through the fore end of each of said opposing and corresponding levers.

2. A nail cutter as claimed in claim 1, further comprising said cutting element being situated between said opposing and corresponding levers, each said opposing and corresponding lever being movable with respect to said cutting element, said cutting element being retained between said opposing and corresponding levers with said pin.

3. A nail cutter as claimed in claim 2, further comprising said cutting element being formed in the shape of a "U".

* * * * *